United States Patent [19]

Debrus

[11] 4,319,609

[45] Mar. 16, 1982

[54] FIVE-POSITION HYDRAULIC ACTUATING APPARATUS

[75] Inventor: Philippe Debrus, Paris, France

[73] Assignee: Societe Anonyme D.B.A., Paris, France

[21] Appl. No.: 137,740

[22] Filed: Apr. 7, 1980

[30] Foreign Application Priority Data

Apr. 6, 1979 [FR] France ..... 79 08814

[51] Int. Cl.[3] ..... F15B 13/043; F15B 11/12

[52] U.S. Cl. ..... 137/625.63; 91/519; 91/535; 91/536; 137/625.64; 137/625.66

[58] Field of Search ..... 91/519, 535, 536; 137/625.63, 625.64, 625.66

[56] References Cited

U.S. PATENT DOCUMENTS 4,067,357 1/1978 Ruchser ..... 137/625.66 X

*Primary Examiner*—Gerald A. Michalsky

[57] ABSTRACT

Hydraulic actuating apparatus with digital input comprising a movable output member spring biased to a neutral position and capable of moving to one or other of two working positions under the effect of opposing hydraulic means, themselves controlled by binary-type control members;

To create two additional working positions for the movable output member (10), the invention provides for each of the driving means to be composed of two active areas ($s_1$, $s'_1$; $s_2$, $s'_2$) acting successively on the output member (10), and for the putting of the first area under pressure to be caused by one of the control members ($EV_1$, $EV_2$) while that of the other area is caused by the other control member provided that the output member has already completed a first displacement step in the required direction;

Particular application to the control of double-acting hydraulic actuators with two rates of displacement in each direction.

8 Claims, 4 Drawing Figures

FIVE-POSITION HYDRAULIC ACTUATING APPARATUS

Figure 1:
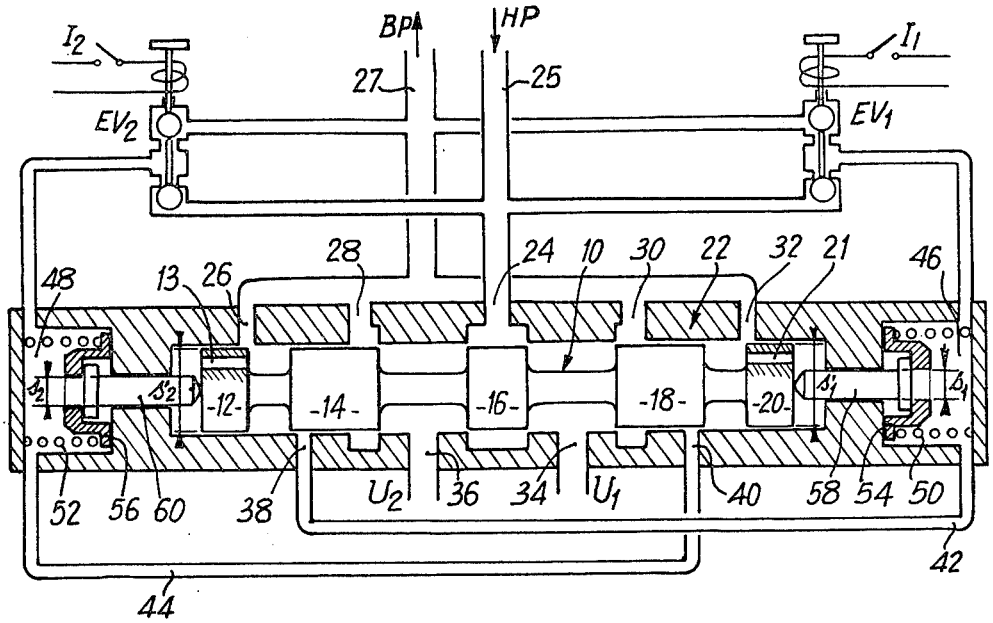

The object of the present invention is a hydraulic actuating apparatus with digital input, and more precisely an apparatus of this type comprising a movable output member occupying, when at rest, a neutral position towards which it is urged by resilient centring means and capable of moving in opposition to the latter to both sides of the said neutral position so as to occupy one or other of two working positions defined by stop means, the displacements of this movable member being caused by opposing hydraulic actuating means each allocated to one direction of displacement and themselves selectively controlled by two two-position control members receiving input commands of a digital nature.

In a typical application of such an actuating apparatus the movable output member is constituted by the spool of a fourway hydraulic valve, which can for example control a double-acting hydraulic actuator; in this instance, the neutral position of the valve spool seals off the two working chambers of the actuator from a source of fluid under pressure, thus immobilizing its piston, while each of the two working positions of the spool causes one or other of the working chambers of the actuator to be put in communication with this source of fluid under pressure, thus bringing about the displacement of its piston in one direction or the other at an identical or non-identical speed.

In such an application, the spool of the valve is only capable of occupying three different positions, as a function of the input commands delivered in the form of binary control words to the actual control members which are constituted, for example, by two-position three-way solenoid-operated valves. Hence, only one single speed is available for each direction of displacement of the piston of the hydraulic actuator.

It is desirable, in fact, in many practical applications, to have two different speeds available for each direction of displacement of the piston of the actuator. However, this presupposes that the spool of the valve is able to occupy five different positions in all, i.e., its neutral position and in addition two successive working positions to each side of this, these successive working positions corresponding to increasing values of the gain in rate of flow of the fluid under pressure towards the relevant working chamber of the actuator. Such a result can be obtained, for example, by means of movable stops coming into action in turn on the spool of the valve, but requires a priori increased complexity in the control members, since, obviously, the two two-position solenoid-operated valves can only receive at the most four different binary control words.

The present invention aims at creating, in a hydraulic control apparatus of the type referred to above, two additional working positions for the movable output member without resorting to additional control means, so as to obtain in all five different positions of equilibrium by means of only four binary control words. This object is achieved, in conformance with the invention, as a result of the fact that each of the hydraulic actuating means is composed of two active areas acting in the same direction on the movable output member and coming into action one after the other to transmit two successive displacement steps to the said member, the putting of the first of these areas under pressure being caused by one of the two control members, and that of the second by the other control member, this only being made possible, however, when the movable member has already completed a first displacement step in the direction concerned. As will appear more clearly in the rest of the description, the driving of one or other of the two control members from the rest position has the consequent effect of displacing the output member in one direction or the other with respect to its neutral position, thus causing it to occupy the first of two successive positions of equilibrium defined in the direction of displacement concerned; and the subsequent driving of the second control member, whatever the direction of the initial displacement, has the consequent effect of bringing the output member into the second of the said positions of equilibrium. In this way, five different positions of equilibrium in all are obtained from only four different control words, provided that the control members are actuated successively and not simultaneously.

In a preferred embodiment of the invention, the two active areas of each of the hydraulic actuating means are respectively constituted by the face of a first piston of relatively small section whose travel is limited by a stop at a first displacement step of the movable output member and by the face of a second piston of relatively large section mounted in series with the preceding and whose travel, also limited by a stop, allows another displacement step of the said member to be covered, the control members associated with the said hydraulic actuating means are each constituted by a two-position three-way valve allowing connection to a supply line of fluid under pressure or to a return line of the face of the first piston of the actuating means allocated to one direction of displacement of the movable output member and of the face of the second piston of the actuating means allocated to the opposite direction of displacement, and the connection between the said valve and the said face of the second piston is controlled by the actual position of the movable output member so as to be established only when the said member has already completed a first displacement step in the direction concerned. In such a case, the connection between the said valve and the said face of the second piston can be advantageously ensured by means of a through-chamber provided in the movable output member, the edges which delimit this chamber cooperating with fixed communication orifices such that they connect either with the corresponding valve or with the return line.

It is moreover possible, by a suitable choice of logic functions for the control valves, to change the nature of the binary control words governing the various positions of equilibrium of the movable output member.

As the following description also shows, the scope of the invention is not limited to merely the obtaining of two successive positions of equilibrium at both sides of the neutral position of the movable output member; it can also extend in certain particular applications to the obtaining of one position of equilibrium only to one side of the neutral position and of three successive positions of equilibrium to the other side of this last; in such a case, the hydraulic actuator controlled by such an apparatus would be provided with one single displacement rate in one direction and three different speeds in the other direction. Other combinations would also be possible within the scope of the present invention.

Figure 2:
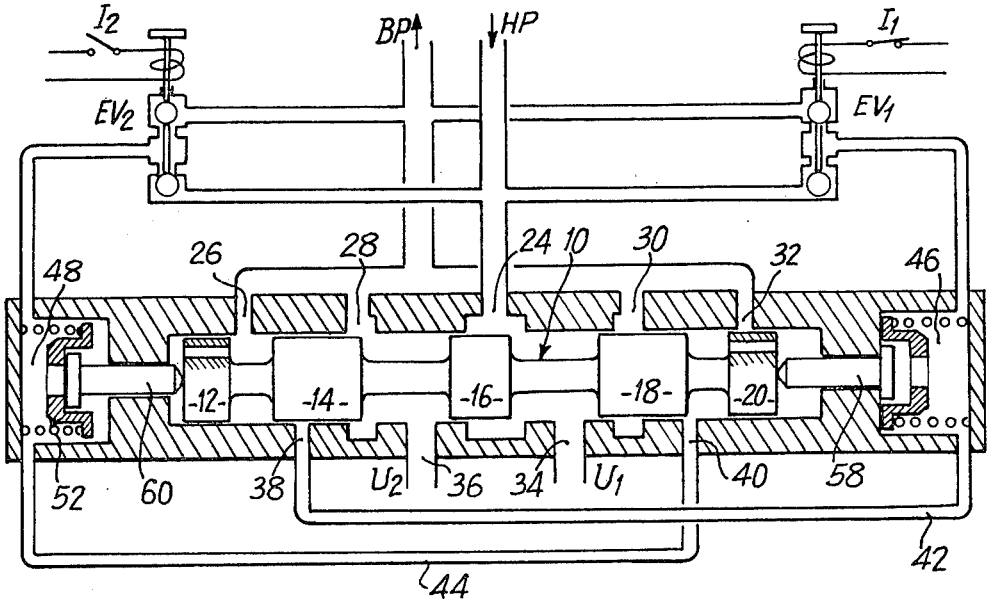
Figure 3:
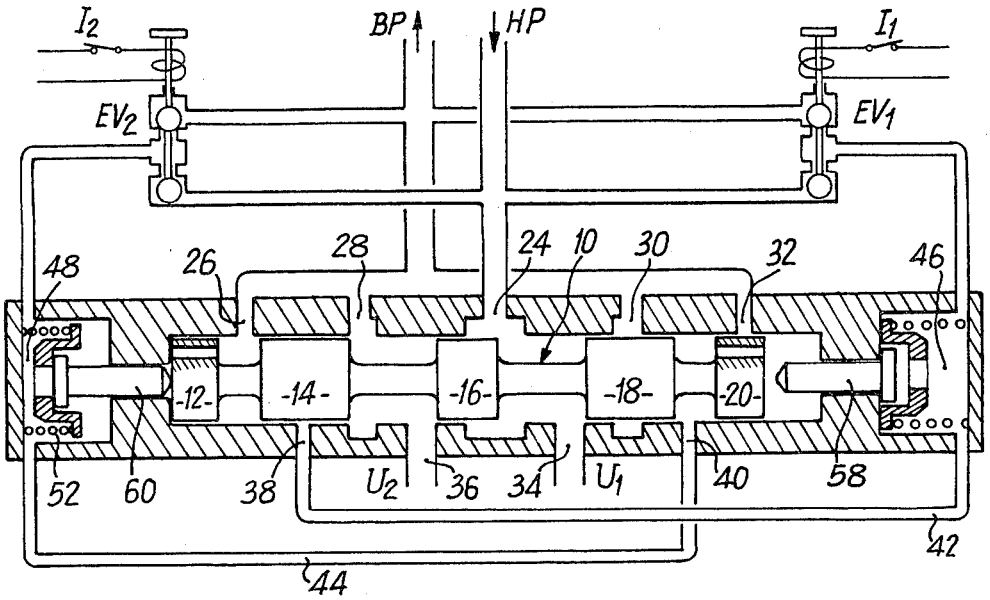
Figure 4:
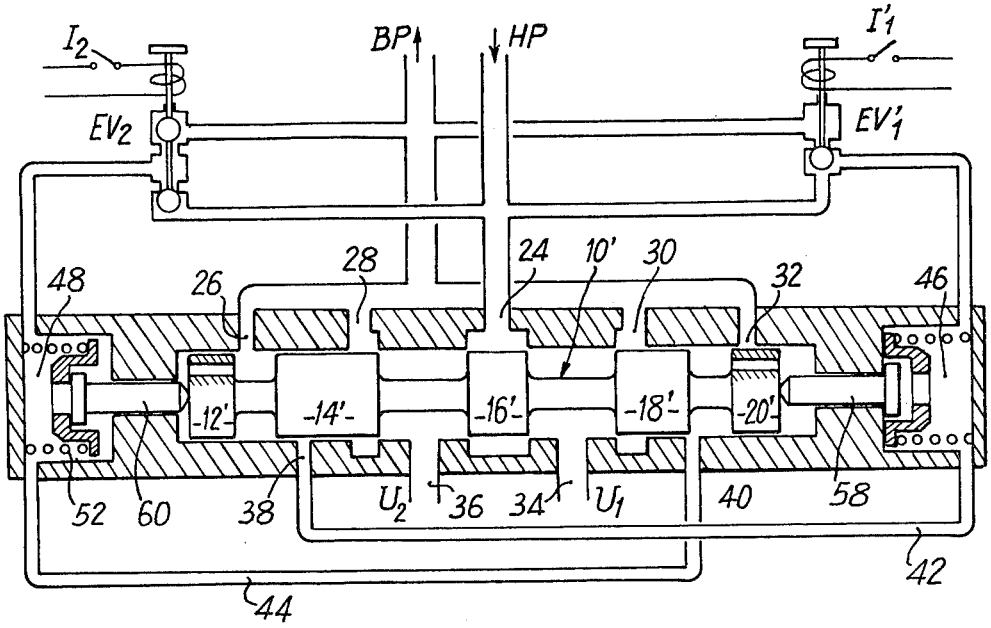

The characteristics and advantages of the invention will be clarified by the following description of some preferred embodiments, given simply by way of illustrative examples, and with reference to the drawings here attached, in which:

FIGS. 1 to 3 illustrate, respectively in neutral position and in two of its successive working positions, a first embodiment of the hydraulic actuating apparatus according to the invention, applied in the case of a five-position solenoid-operated valve; and FIG. 4 represents, also in diagrammatic form, a second embodiment of such a solenoid-operated valve, shown in its neutral position.

With reference first to FIG. 1 of the drawings, it can be seen that the hydraulic actuating apparatus according to the invention comprises a movable output member 10 here constituted by a hydraulic spool valve, which is provided with five cylindrical lands 12, 14, 16, 18 and 20. This spool 10 is received slidingly in a bored fixed body 22, itself pierced with a certain number of orifices intended to cooperate with the edges delimiting the cylindrical lands of the spool 10 so as to define fluid passages of variable section. More precisely, one of these orifices, indicated by the reference 24, is connected via a conduit 25 to a source of fluid at high pressure HP (not represented in the drawing); while four other orifices 26, 28, 30 and 32 are connected via another conduit 27 to a fluid return tank BP (also not represented in the drawing). Two other orifices 34 and 36 are respectively connected, via outlet pipes $U_1$, $U_2$, to the working chambers of a doubleacting hydraulic actuator, which does not form part of the invention and is not represented in the drawing. Two other additional orifices 38 and 40 are respectively connected, via pipes 42 and 44, to two pressure chambers 46 and 48 as well as to the outlets of two solenoid-operated valves $EV_1$ and $EV_2$ constituting the control members, properly so-called, of the apparatus. Each of the two pressure chambers 46 and 48, which are disposed coaxially with respect to the spool 10 of the valve inside the body 22, contain a compression spring 50 or 52 which, via a cup 54 or 56, tends to push back towards the spool of the valve a piston 58 or 60 which slides sealingly in a fixed wall of the body 22, and whose end is normally kept in contact with one of the end-faces of the spool 10. Each of the solenoid-operated valve $EV_1$ and $EV_2$, of the two-position three-way type, includes two inlets respectively connected by branch pipes to the conduits 25 and 27. Switches $I_1$ and $I_2$ are respectively provided to actuate these two solenoid-operated valves so that, when the switch is open, the associated solenoid-operated valve occupies such a position that it puts this same outlet in connection with the source of fluid under pressure HP.

In the neutral position represented in FIG. 1 of the drawings, the two switches $I_1$ and $I_2$ are open, which will be expressed conventionally by a binary control word "00". Consequently, low pressure prevails in the two chambers 46 and 48, as well as on both sides also of the cylindrical lands 12 and 20 of the spool 10, whose opposite faces communicate via a longitudinal boring 13 or 21. The result of the hydraulic pressures exerted in the opposite direction on the spool 10 is zero, and the latter is therefore centered in its neutral position by the resilient return means constituted by the springs 50 and 52 acting, via the cups 54 and 56, on the pistons 58 and 60 which are themselves in contact with the end faces of the said spool. The opposite edges of the cylindrical land 16 consequently seal both sides of the orifice 24 communicating with the source of fluid under pressure HP, and hence, since the fluid is not able to escape from any of the chambers of the actuator, the latter is hydraulically locked and hence the piston of the actuator remains immobile as a consequence, except for leakages, whatever the external load applied.

With reference now to FIG. 2 of the drawings, it can be seen that the switch $I_1$ is closed while the switch $I_2$ remains open, which is conventionally translated by a binary control word such as "10". As a result, while the pressure chamber 48 remains connected to the return tank BP, the pressure chamber 46 is now put in communication, via the solenoidoperated valve $EV_1$, with the source of fluid under pressure HP. This has the effect of pushing the piston 58 back towards the left until its enlarged head comes to abut on the wall of the fixed body 22, and consequently of imparting a first displacement step leftwards to the spool 10 in opposition to the force developed by the spring 52. It will moreover be noted that the putting of the orifice 38 under pressure, via the pipe 42, has no effect, since this orifice is initially sealed by the cylindrical land 14. In addition, the end faces of the spool 10 both remain exposed to low pressure, the pipe 44 and the orifice 40 being substituted for the orifice 32 now covered by the cylindrical land 20. In this position of the spool 10, it can be seen that the orifice 24 is partly open at its right side, which has the effect of putting the orifice 34 and the outlet pipe $U_1$ in communication with the source of fluid under pressure, while limiting the rate of flow of the fluid through this pipe $U_1$; the orifice 36 and the pipe $U_2$ are also now put in communication with the orifice 28 and the return tank BP. A differential pressure consequently appears on both sides of the piston of the controlled actuator, which is thus displaced in the corresponding direction at a certain value of speed of translation.

If the piston of the actuator is now required to be displaced in the same direction but with a greater translation speed value, the control switch $I_2$ is simply closed in its turn (binary control word "11"). This operation has the effect of putting the pressure chamber 48 as well as, via the pipe 44 and the orifice 40, the right end face of the spool 10 in communication with the source of fluid under pressure HP. As the active area $s'_1$ of this end face of the spool 10 is, by design, larger than the active area $s_2$ of the piston 60 on which the high pressure is also exerted, there is a consequent disequilibrium between the hydraulic thrusts exerted on the spool 10, the result of such thrusts having the effect of imparting to this spool 10 a second displacement step leftwards, until its left end face comes to abut against the corresponding wall of the body 22. In the new working position reached by the spool 10, it can be seen that the orifice 24 is now fully open at its right side, which means that the outlet pipe $U_1$ is supplied with fluid under pressure with a value of gain in rate greater than that in the previous instance; as a result, the piston of the actuator is easily displaced with a greater translation speed value.

Resuming the previous reasoning but assuming that the switch $I_2$ is closed first, leaving the switch $I_1$ open (binary control word "01"), it can easily be seen that this operation has the effect of imparting a first displacement step rightwards to the spool 10, followed by a second displacement step in this same direction on subsequent closure of the switch $I_1$ (binary control word "11"). Thus, with the use of only two binary-type control members ($EV_1$, $EV_2$) capable of receiving four different binary control words in all, five different positions of equilibrium for the spool 10 of the hydraulic valve are readily available, i.e. a neutral position and two successive working positions on each side of this neutral position, these different positions corresponding respectively to the immobilization of the piston of the controlled hydraulic actuator and to its displacement with two different values of speed of translation in each of the two directions.

It is clear from the preceding description that the hydraulic actuating means which control the displacements of the output member rightwards or leftwards in opposition to the resilient centring means constituted by the springs 50 and 52 are each composed of two active areas acting in the same direction on this output member (spool 10) and coming into action one after the other to communicate two successive displacement steps to it, the putting of the first of these areas under pressure being caused by one of the control solenoid-operated valves $EV_1$ or $EV_2$ and that of the second area by the other of these solenoid-operated valves, this only being made possible, however, when this output member has already completed a first displacement step in the required direction. In the embodiment represented, the active areas of each of these hydraulic actuating means are constituted respectively by the face of a first piston 58 or 60 of relatively small section whose travel is limited to a first displacement step of the output member 10, and by the end face of this last acting as a second piston of relatively large section mounted in series with the preceding and whose travel, also limited, allows a second displacement step to be covered. It is important to emphasize that the face of the second piston can only be put under pressure if the movable output member 10 has already completed a first displacement step in the direction concerned. It is quite clear that the application of this general principle of the invention can be achieved by means of other technical means than those described above, which would not thereby limit the scope of the invention. Similarly, it would evidently be possible to use solenoid-operated valves for control with inverse logic function, i.e. solenoid-operated valves whose non-excited state would be translated by their outlet being put in communication with the source of fluid under pressure; in such a case, the binary control word corresponding to the neutral position would obviously be "11", those controlling the intermediate positions of equilibrium would be "01" and "10" respectively, and the single control word for the outermost positions of equilibrium would be "00" following on the previous ones.

Finally, it should be noted that the scope of the invention is not limited to the constructing of hydraulic actuating apparatuses with five positions distributed symmetrically with respect to a neutral position. FIG. 4 of the drawings illustrates, simply by way of example, a variant of embodiment in which a single position of equilibrium for the movable output member to one side of the neutral position and three positions of equilibrium to the other side of this same position are provided, the view of the drawing corresponding to the neutral position. In this instance, it can be seen that the lands 14' and 18' of the movable spool 10' are no longer shaped symmetrically with respect to its central land 16', as was the case in the embodiment of FIGS. 1 to 3. Moreover, the control members are here constituted by two solenoid-operated valves $EV_1'$ and $EV_2$ provided with opposite logic functions, the first establishing communication with the source of fluid under pressure HP when it is not excited (switch $I'_1$ open), while the second conversely establishes this same communication when it is excited (switch $I_2$ closed). When the two switches $I'_1$ and $I_2$ are consequently open (which corresponds conventionally to delivery of a binary control word "00"), the pressure chamber 46 is connected to the source of fluid HP while the chamber 48 is sealed off from it; the piston 58 is consequently driven leftwards and pushes back the spool 10' in opposition to the force developed by the springs, however, the valve is so constructed that, for this position, the central cylindrical land 16' of the spool 10' seals the orifice 24 for admitting fluid under pressure on both sides, while the lands 14' and 18' respectively seal the return orifices 28 and 30. In these conditions, the outlet pipes $U_1$ and $U_2$, as well as the working chambers of the controlled hydraulic actuator, are completely closed, which corresponds to the immobilization of the piston of this actuator. Resuming the reasoning previously applied, it is possible to see, from this position, that the closure of the switch $I_2$ will have the effect of displacing the spool 10' leftwards, until its left end face comes to abut against the wall of the fixed body 22. Conversely, closure of the switch $I'_1$ would have the effect of preventing the disequilibrium between the hydraulic thrusts acting on the spool 10', so that this would be displaced by a first step rightwards under the action of centring means constituted by the springs 50 and 52. Subsequent closure of the switch $I_2$ would cause a new displacement step of the spool 10' rightwards, and the subsequent opening of the switch $I'_1$ would finally bring the spool 10' into its outermost position defined by its right end face coming to abut on the corresponding wall of the fixed body. These three successive positions of equilibrium to the same side of the neutral position of FIG. 4 correspond to the progressive degrees of opening of the orifice 24 leftwards, and consequently to the increasing values of the gain in flow of fluid under pressure admitted into the outlet pipe $U_2$. As a consequence, the hydraulic actuator controlled by such an actuating apparatus will be provided with one single value of speed of translation in one direction and three progressive values of this same speed in the opposite direction.

It is of course self-evident that other further combinations would be possible, and it will therefore be understood that the embodiments described above constitute only purely illustrative examples of the ways in which the invention can be applied.

I claim:

1. Hydraulic actuating apparatus with digital input, of the type comprising a movable output member occupying, when at rest, a neutral position towards which it is urged by resilient centring means and capable of moving in opposition to these last to both sides of the said neutral position so as to occupy one or other of two working positions defined by stop means, the displacements of this movable member being caused by opposing hydraulic actuating means each allocated to one direction of displacement and themselves selectively controlled by two two-position control members receiving input commands of a digital nature, characterized by the fact that, to create without resorting to additional control means two additional working positions for the movable output member which are also defined by stop means and to thus obtain five different positions of equilibrium by means of only four binary control words, each of the hydraulic actuating means is composed of two active areas ($s_1$, $s'_1$; $s_2$, $s'_2$) acting in the same direction on the movable output member (10)

and coming into action one after the other so as to transmit two successive displacement steps to the said member, the putting under pressure of the first ($s_1$; $s_2$) of these areas being caused by one ($EV_1$; $EV_2$) of the two control members, and that of the second area ($s'_1$; $s'_2$) by the other control member ($EV_2$; $EV_1$), this only being made possible, however, when the movable member has already completed a first displacement step in the direction concerned.

2. Hydraulic actuating apparatus according to claim 1, characterized by the fact that the two active areas of each of the hydraulic actuating means are respectively constituted by the face of a first piston (58; 60) of relatively small section whose travel is limited by a stop at a first displacement step of the movable output member (10) and the face of a second piston (20; 12) of relatively large section mounted in series with the preceding and whose travel, also limited by a stop, allows another displacement step of the said member to be covered, that the control members associated with the said hydraulic actuating means are each constituted by a two-position three-way valve ($EV_1$; $EV_2$) allowing connection to a supply line of fluid under pressure or to a return line of the face of the first piston (58; 60) of the actuating means allocated to one direction of displacement of the movable output member and of the face of the second piston (12; 20) of the actuating means allocated to the opposite direction of displacement, and that the connection between the said valve and the said face of the second piston is controlled by the actual position of the movable output member so as to be established only when the said member has already completed a first displacement step in the direction concerned.

3. Hydraulic actuating apparatus according to claim 2, characterized by the fact that the connection between the said valve and the said face of the second piston is effected by means of a through-chamber provided in the movable output member, the edges which delimit this chamber cooperating with fixed communication orifices (38, 26, 40, 32) in such a manner that they connect either with the corresponding valve or with the return line.

4. Hydraulic actuating apparatus according to any one of claims 1 to 3, characterized by the fact that, to obtain two different positions of equilibrium of the movable output member to each side of the neutral position, the control members are constituted by two solenoid-operated valves with identical logic functions consisting in establishing communication with the return line when they are non-excited, the neutral position of the movable output member being controlled in this instance by the binary word "00", the intermediate positions of equilibrium respectively by the words "01" and "10" (or by the binary words "10" and "01"), and the outermost positions of equilibrium by the word "11" succeeding the previous one.

5. Hydraulic actuating apparatus according to any one of claims 1 to 3, characterized by the fact that, to obtain a single position of equilibrium of the movable output member to one side of the neutral position and three different positions of equilibrium to the other side of this neutral position, the control members are constituted by two solenoid-operated valves with reversed logic functions consisting in establishing communication with the return line when they are respectively excited or non-excited, the neutral position of the movable output member being controlled in this instance by the binary word "00", its single position of equilibrium to one side of the neutral position by the word "01", and its three successive positions of equilibrium to the other side of the neutral position respectively by the words "10", "11" and "01" in succession.

6. Hydraulic actuating apparatus according to any one of claims 1 to 3, characterized by the fact that the movable output member is constituted by a four-way spool valve (10), for example of the "closed centre" type, allowing either simultaneous sealing-off of two working orifices ($U_1$; $U_2$) when it occupies its neutral position or connection of one of these orifices to a supply line for fluid under pressure and of the other orifice to a return line in all its other positions of equilibrium, the successive positions of equilibrium of this spool at the same side of the neutral position therefore corresponding to increasing values of the rate of flow of the fluid through the said working orifices.

7. Hydraulic actuating apparatus according to claim 6, characterized by the fact that it is used to control a double-acting hydraulic actuator member, the successive positions of equilibrium of the spool to one same side of the neutral position therefore corresponding to the increasing speeds of the said actuator member for the displacement direction concerned.

8. Hydraulic actuating apparatus according to any one of claims 1 to 3, characterized by the fact that, to obtain two different positions of equilibrium of the movable output member to each side of the neutral position, the control members are constituted by two solenoid-operated valves with identical logic functions consisting in establishing communication with the return line when they are excited, the neutral position of the movable output member being controlled in this instance by the binary word "11", the intermediate positions of equilibrium respectively by the words "10" and "01", and the outermost positions of equilibrium by the word "00" succeeding the previous one.

* * * * *